US006332712B1

(12) United States Patent
Headley

(10) Patent No.: US 6,332,712 B1
(45) Date of Patent: Dec. 25, 2001

(54) LUNCH BAG

(76) Inventor: Eva L. Headley, 3102 24th Street NE., Washington, DC (US) 20018

( * ) Notice: Subject to any disclaimer, the term of this patent is extended or adjusted under 35 U.S.C. 154(b) by 0 days.

(21) Appl. No.: 09/684,428

(22) Filed: Oct. 10, 2000

Related U.S. Application Data

(60) Provisional application No. 60/166,740, filed on Nov. 22, 1999.

(51) Int. Cl.[7] ..... B65D 33/25

(52) U.S. Cl. ..... 383/64; 383/61; 383/89; 383/104; 383/120

(58) Field of Search ..... 383/61, 63, 64, 383/89, 104, 120, 122, 907

(56) References Cited

U.S. PATENT DOCUMENTS 5,244,136 * 9/1993 Collaso ..... 383/61 X
5,403,094 4/1995 Tomic .
5,490,396 * 2/1996 Morris ..... 383/110 X
5,713,669 2/1998 Thomas et al. .
5,788,378 8/1998 Thomas .
5,816,709 * 10/1998 Demus ..... 383/61
6,146,016 * 11/2000 Mucci et al. ..... 383/89 X

FOREIGN PATENT DOCUMENTS

0133747 * 6/1991 (JP) ..... 383/907

* cited by examiner

*Primary Examiner*—Jes F. Pascua
(74) *Attorney, Agent, or Firm*—Richard C. Litman

(57) ABSTRACT

A pressure sealed bag made of a strong flexible plastic that has the structural integrity to remain upright when placed on its bottom surface while the upper portion of the bag has the flexibility to fold neatly over onto itself so that the bag can be readily grasped by the hand. An innovative dual locking mechanism ensures the contents of the bag are secure. The pressure sealed bag has a label area where information can be readily displayed.

5 Claims, 3 Drawing Sheets

LUNCH BAG

CROSS-REFERENCE TO RELATED APPLICATION

This application claims the benefit of U.S. Provisional Patent application Ser. No. 60/166,740, filed Nov. 22, 1999.

BACKGROUND OF THE INVENTION

1. Field of the Invention

The present invention relates generally to storage bags and more particularly, to an airtight, water-resistant, semi-foldable, and recloseable storage bag for enclosing items such as food products or cosmetics. The storage bag of the present invention is self-standing, disposable, and pressure sealed around its mouth 2. Description of the Related Art Finding an appropriate carrying container for a person's lunch or other personal items that is properly sized, convenient to use, disposable, and consumer friendly is not easy. The consumer market is full of flexible containers made of different materials and having a variety of shapes and sizes. However, finding a flexible container that is appropriate for a specific need or that possesses the characteristics needed under specific circumstances can be challenging. A flexible carrying bag or a flexible storage container is often either too small or too large or too oddly shaped to meet a person's needs and requires frequent cleaning. For example, a flexible carrying bag may be easily carried by hand but may not fit conveniently into a larger enclosure, such as a purse. A flexible storage container may fit neatly onto a shelf but be very difficult to carry in a person's hand.

It would extremely advantageous to have a flexible container that could be readily used for both the storage and the transport of a wide variety of items. The prior art describes a number of flexible storage bags, for example, a recloseable container is described in U.S. Pat. No. 5,397,182 issued on Mar. 14, 1995 to S.C. Gaible et al. The recloseable plastic bag has extruded plastic side walls with a profile strip or web along an open end of the bag for receiving printed information for identifying bag contents and related information.

U.S. Pat. No. 5,403,094 issued on Apr. 4, 1995 to M. Tomic describes a recloseable zipper for a recloseable bag. The recloseable zipper consists of a pair of closures that are disposed adjacent and opposite to one another. The closures are configured to interlock with one another over a predetermined length and at least one of the closures is provided with intermittent transverse notches to enhance the ease of interlocking the closures. A recloseable stand-up bag is described in U.S. Pat. No. 5,788,378 issued on Aug. 4, 1998 to T. R. Thomas. The recloseable bag is manufactured in a generally vertical production line. The recloseable bag is suitable for stand-alone marketing, or placing inside of a rectangular box container such as a cereal box.

None of the above inventions and patents, taken either singly or in combination, is seen to describe the instant invention as claimed.

SUMMARY OF THE INVENTION

Accordingly, it is a principal object of the invention to provide a durable, flexible, and disposable pressure sealed bag that is comfortable to grasp with the hand.

It is another object of the invention to provide a durable, flexible, pressure sealed bag that has the structural integrity to stand upright when placed on its bottom surface.

It is a further object of the invention to provide a durable, flexible, pressure sealed bag that is airtight and that will securely retain any spillage that might occur within the bag.

Still another object of the invention is to provide a durable, flexible, pressure sealed bag that has an economic design that results in the use of less material to manufacture the bag.

It is an object of the invention to provide improved elements and arrangements thereof in a durable, flexible, and disposable pressure sealed bag for the purposes described which is inexpensive, dependable and fully effective in accomplishing its intended purposes.

To accomplish the foregoing objectives, the present invention provides a durable, flexible, and disposable pressure sealed bag that is airtight and that has the structural integrity to stand upright on its own. The pressure sealed bag of present invention is made of a durable yet flexible plastic gusseted bag having a conformation similar to the proverbial "brown paper bag." Items inside the bag of the present invention are secured by a dual locking mechanism. The first is pressure seal at the mouth of the bag and the second is a pair of hook and loop fastening strips such as Velcro® that is horizontally disposed on one side of the bag. The upper portion of the bag folds over onto itself thereby establishing contact between the two mating surfaces of the fastening strips and further securing the contents of the bag. In a preferred embodiment, the pressure sealed bag is made of a polyethylene film and has a pressure sealing slider assembly such as a ZIP-LOC® seal at its mouth.

The pressure sealed bag of the present invention has a label or white section for writing information such as a person's name or the nature of the items in the bag. The sturdy, durable bottom portion of the bag is ideal for supporting heavy items such as a bowl or fruit when used as a lunch bag. In the preferred embodiment, the pressure sealed bag has a decorative exterior, for example, the exterior of the bag could display cartoon characters which makes an excellent lunch bag for children.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
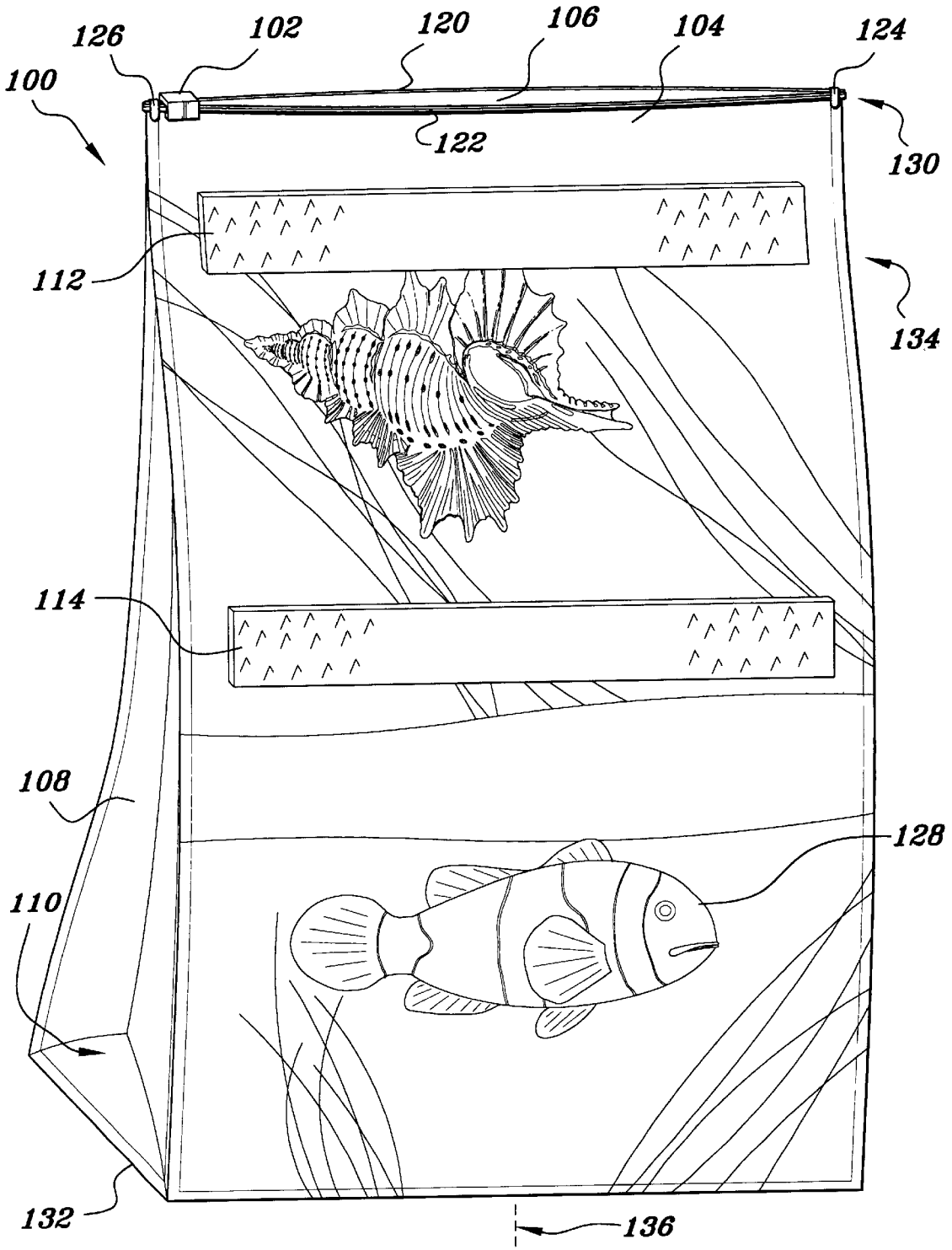
FIG. 1 is a perspective view of a preferred embodiment of a disposable pressure sealed bag according to the present invention.

FIG. 1 which shows a perspective view of a preferred embodiment of a disposable pressure sealed bag 100 according to the present invention. The pressure sealed bag 100 comprises an anterior wall 104, a posterior wall 106, a pair of triangular lateral sidewalls or walls (108, 116), a bottom wall 118 (seen in FIG. 3), and a slider assembly or zipper (102, 120, 122, 124, 126). The pressure sealed bag 100 of the present invention has gussets similar to the proverbial "brown paper bag." The pressure sealed bag 100 of the present invention is made of a low density polyethylene film having a thickness of approximately 3 mils; however, for heavy duty uses, a strong durable thick plastic similar in thickness to that of a plastic shower curtain can be used. The pressure sealed bag 100 can also be made of a copolymer film, a polypropylene film, or any similar material having a thickness in the range of 2 to 5 mils. The thickness of the plastic can be varied to meet the specific needs of the items to be carried or stored.

The anterior wall or surface 104 and the posterior wall or surface 106 extend from opposite sides of the bottom wall 118 and converge at the top 130 of the bag 100 where a pressure sealing slider assembly (102, 120, 122, 124, 126) is attached. The zipper or slider assembly comprises a slider 102, a pair of strips (120, 122) that engage and disengage as the slider 102 is slid in opposite directions, and a pair of end clips (124, 126) that are used to secure the slider assembly to the bag 100. The top portion of the bag 100 is constructed in such a manner as to produce an airtight seal when the slider assembly or zipper is closed.

The pressure sealed bag 100 of the present invention is configured so that the bag 100 is tapered with the largest segment of the interior volume of the bag 100 residing at the bottom portion of the bag 100. This tapered configuration makes it possible to place a large number of items into the bag 100 and still have enough of the bag 100 available to be easily grasped by a person's hand. Furthermore, the tapered configuration endows the pressure sealed bag 100 with unique characteristics. The wide base 132 of the bag 100 and the fact that the majority of the volume of the bag 100 resides at the bottom or lower portion of the bag 100 provides the bag 100 with the necessary structural integrity so that the bag 100 stands upright on its own when the bag 100 is placed on its bottom surface or wall 118. However, because the width of the side walls 108 and 116 is narrower towards the upper portion 134 of the bag 100, the upper portion 134 of the bag 100 is readily folded over onto itself for easy grasping of the bag 100 by a person's hand. The bottom wall 118 of the bag 100 can be reinforced with a second layer (not shown) of thick plastic to further increase the load bearing capacity of the bag 100. The exact dimensions of the pressure sealed bag 100 can be scaled up or down to meet the needs of the user, for example, in the preferred embodiment, the bag 100 has a height of 13 inches, a width of 8½ inches, and a maximum depth of 2 inches.

In the preferred embodiment, a pair of hook and loop fastener strips (112, 114) are horizontally disposed on the anterior or front wall 104 of the bag 100. A first fastener strip 112 is spaced downwardly from said mouth, and a second 114 fastener strip is spaced parallel to the first fastener strip. Each fastener strip (112, 114) has an orientation normal to the vertical axis 136 of the bag 100 so that when the upper portion 134 of the bag 100 is folded over onto itself, the pair of fastener strips (112, 114) are aligned and engaged, thereby further securing the contents of the bag 100. The fastening means of the pressure sealed bag 100 can be configured to any suitable shape that allows a secure fastening. For example, the hook and loop fasteners can have a circular configuration.

The posterior or rear wall 106 of the pressure sealed bag 100 has a label area or white section (hidden) for displaying written information such as a person's name or the nature of the contents of the bag 100. The pressure sealed bag 100 can be transparent or opaque. The plastic of the pressure sealed bag 100 can be colored or have a decorative pattern 128. In an alternate embodiment, the pressure sealed bag 100 may have no decorative pattern or hook and loop fastening means.

Figure 2:
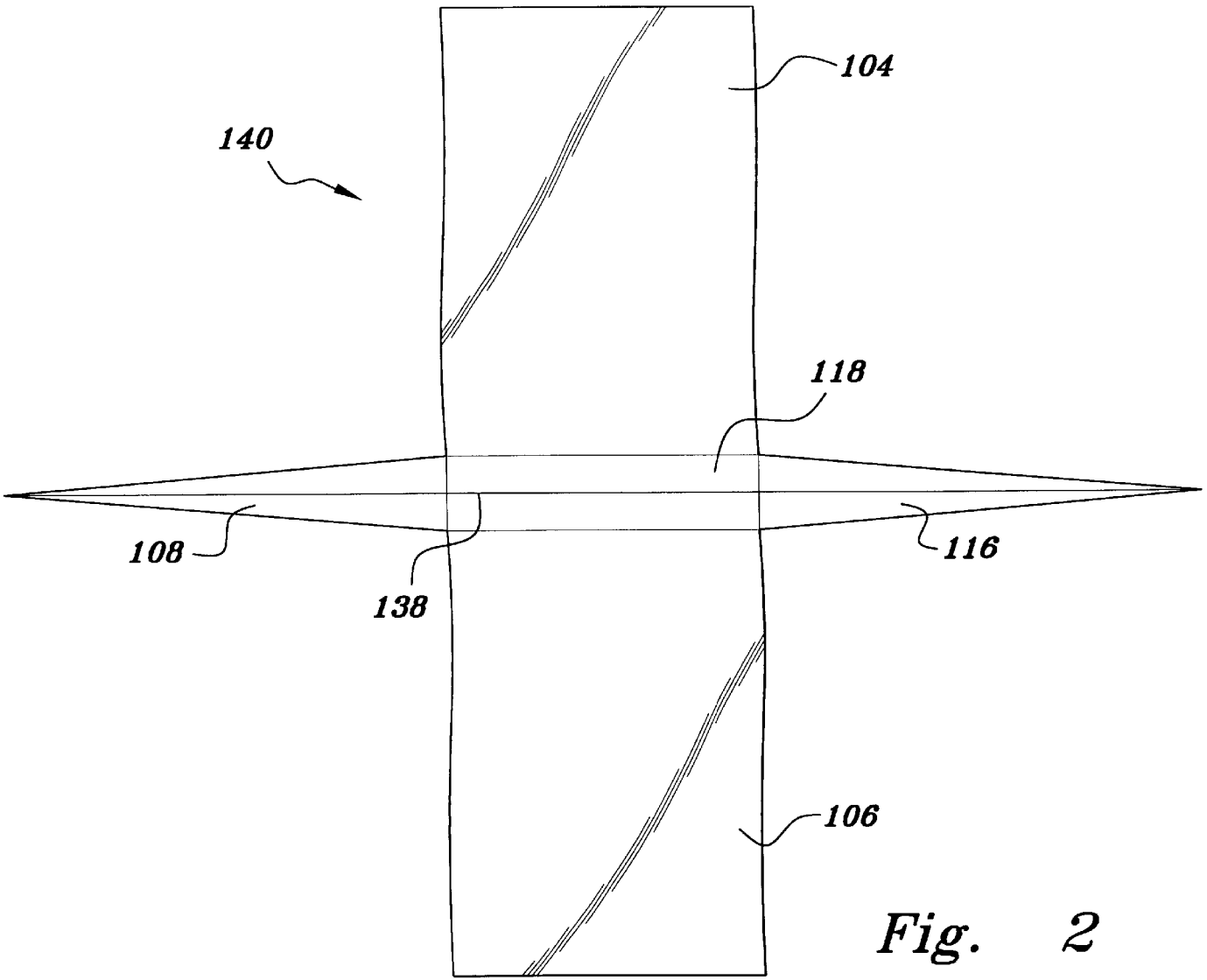
FIG. 2 is a top view of plastic material cut into the configuration that constitutes the starting point for the making of the pressure sealed bag.

FIG. 2 is a top view of plastic material 140 cut into the configuration that constitutes the starting point for the making of the pressure sealed bag 100. The pressure sealed bag 100 is made from a single piece of plastic 140 cut into a configuration which when properly folded results in the configuration depicted in FIG. 1. The elongated triangular configuration of the lateral sidewalls (108, 116) produces the tapered contour of the pressure sealed bag 100. The seams of the gusseted pressure sealed bag 100 are heat sealed to ensure the airtightness of the bag 100. A crease 138 that runs the entire length of the two lateral sidewalls (108, 116) and the bottom wall 118 produces an infolding 110 of the lateral sidewalls (108, 116) forming gussets and an infolding of the bottom wall 118 which serves to provide predetermined folds for collapsing the bag 100 when not in use. When the bag 100 is opened, expansion of the lateral walls 108, 116 and bottom wall 118 provide a stable, broad base 132 for the bag 100 when the bag 100 is standing in an upright position by centralizing the weight distribution of the contents inside the bag 100.

Figure 3:
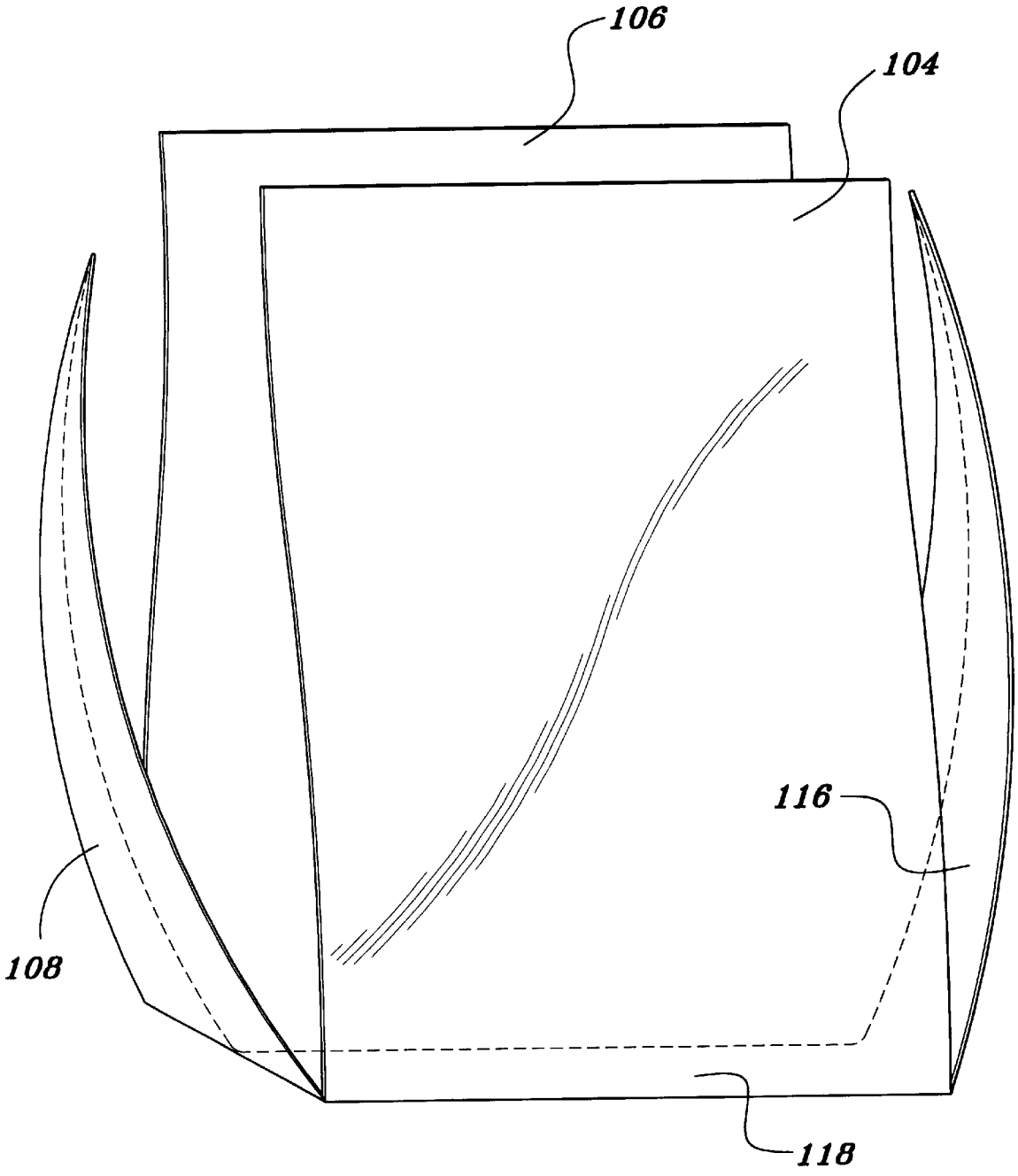
FIG. 3 is a perspective view of an intermediate step in the process of making the pressure sealed bag.

FIG. 3 is a perspective view of an intermediate step in the process of making the pressure sealed bag 100 where the anterior wall 104, the posterior wall 106, and the elongated triangular sidewalls (108, 116) are aligned.

The pressure sealed bag of the present invention makes an excellent lunch bag especially for people with children because a child's lunch usually includes some type of beverage and if anything spills or leaks inside the bag, the spillage or leakage remains inside the bag, unlike the conventional brown paper bag that breaks apart when wet. The pressure sealed bag is excellent for carrying personal items, such as cosmetics. The pressure sealed bag could be colored any color such as red or blue to prevent anyone from seeing the contents of the bag. A decorative pressure sealed bag would make an excellent arts and craft bag and a pressure sealed bag showcasing cartoon characters would be superb for children. The sturdy bottom of the bag ensures that heavy items such a bowl or fruit do not fall through the bottom of the bag. The airtight feature of the bag ensures that perishable items such as cookies stay fresh. The pressure sealed bag of the present invention can be made from any suitable material with the appropriate properties.

The preferred embodiments of the present invention disclosed herein are intended to be illustrative only and are not intended to limit the scope of the invention. It should be understood by those skilled in the art that various modifications and adaptations of the present invention as well as alternative embodiments of the present invention may be contemplated. It is to be understood that the present invention is not limited to the sole embodiments described above, but encompasses any and all embodiments within the scope of the following claims.

I claim:

1. A durable, flexible and disposable gusseted bag comprising:

a rectangular anterior wall having an upper end, a base end and two opposing sides;

a rectangular posterior wall having an upper end, a base end and two opposing sides;

two opposing triangular lateral walls, each having two equal elongated sides and a base, the two elongated sides of each of said lateral walls joining said anterior wall to said posterior wall along their respective two opposing sides;

a rectangular bottom wall joined to said anterior wall and said posterior wall along their respective base ends, and joined to said lateral walls along their respective bases;

said lateral walls and said bottom wall includes respective creases defining gussets for infolding of said lateral walls and said bottom wall;

said anterior wall and said posterior wall intersecting at their respective upper ends to form a mouth;

a pressure sealing slider assembly disposed at said mouth and having a bead type seal and a slider for alternately closing and opening said mouth; and a pair of mating fastener strips extending horizontally across said anterior wall at an upper portion of said bag, a first of said fastener strips being spaced downwardly from said mouth, and a second of said fastener strips being spaced parallel to the first of said fastener strips for removably fastening of the upper portion of said bag in a folded over position.

2. The gusseted bag according to claim 1, wherein said fastener strips are made of hook and loop fastening material.

3. The gusseted bag according to claim 1, wherein said bag is made of a polyethylene film.

4. The gusseted bag according to claim 1, wherein at least one of said walls is decorated.

5. The gusseted bag according to claim 1, wherein said walls are opaque.

* * * * *